US006973709B2

(12) United States Patent
Huang

(10) Patent No.: US 6,973,709 B2
(45) Date of Patent: Dec. 13, 2005

(54) METHOD OF MANUFACTURING PRINTED-ON-DISPLAY ANTENNA FOR WIRELESS DEVICE

(75) Inventor: Chi-Fang Huang, Taipei (TW)

(73) Assignee: Chunghwa Picture Tubes, Taipei (TW)

( * ) Notice: Subject to any disclaimer, the term of this patent is extended or adjusted under 35 U.S.C. 154(b) by 813 days.

(21) Appl. No.: 09/837,465

(22) Filed: Apr. 19, 2001

(65) Prior Publication Data

US 2002/0152606 A1 Oct. 24, 2002

(51) Int. Cl.[7] ..... H01P 11/00

(52) U.S. Cl. ..... 29/600; 29/601; 29/825; 343/702

(58) Field of Search ..... 29/600, 601, 602.1, 29/25.42, 841, 832; 361/737, 749, 783; 343/895, 702, 700 MS; 340/825.54; 336/200; 174/250, 261; 455/89, 90, 293, 323

(56) References Cited

U.S. PATENT DOCUMENTS 5,235,736 A * 8/1993 Hahs et al. ..... 29/600
5,451,965 A * 9/1995 Matsumoto ..... 343/702
6,018,299 A * 1/2000 Eberhardt ..... 340/572.7
6,195,858 B1 * 3/2001 Ferguson et al. ..... 29/25.42
6,670,922 B1 * 12/2003 Huang et al. ..... 343/700 MS
6,707,431 B2 * 3/2004 Byun et al. ..... 343/702
2002/0152606 A1 * 10/2002 Huang ..... 29/601

* cited by examiner

*Primary Examiner*—Minh Trinh
(74) *Attorney, Agent, or Firm*—Jianq Chyun IP Office

(57) ABSTRACT

A method of manufacturing a printed-on-display (POD) antenna for a wireless device is provided. First, a conductive transparent layer comprising indium oxide doped with tin oxide (ITO) is coated on a glass substrate. Next, a photoresist layer is coated on the conductive transparent layer and then a mask having an antenna pattern is disposed on the photoresist layer. Next, the mask is exposed by ultraviolet (UV) rays. Thereafter, the photoresist layer is developed and cured. Finally, the conductive transparent layer is etched to form a patterned conductive transparent layer and subsequently the patterned photoresist layer is removed.

10 Claims, 3 Drawing Sheets

METHOD OF MANUFACTURING PRINTED-ON-DISPLAY ANTENNA FOR WIRELESS DEVICE

FIELD OF THE INVENTION

The present invention relates to antennas and more particularly to a printed-on-display antenna of wireless mobile personal terminal.

BACKGROUND OF THE INVENTION

Recently, a variety of wireless communication services are booming in which wireless mobile personal terminals are the main development field. The features of the personal terminal is portable, an as large as possible display for ease of viewing, and served as a browser for the Internet or as a map display associated with GPS for providing service to travelers. One thing has to overcome by the manufacturers is that after above requirements have been met, how to manufacture one personal terminal which is also slim, compact, and user friendly. In the case of mobile phone (or PDA), the semiconductor based components thereof have been integrated as small as possible even the rechargeable battery is formed of polymeric material. However, such antenna is exposed on the housing of mobile phone because the transmission or receiving of signals from mobile phone is restricted in direction. It is known that such antenna has a predetermined length. Hence, such antenna is disadvantageous for occupying precious space, liable to damage, complex in assembly, and high in cost. Such exposed antenna limits a further reduction of mobile phone. Thus, it is desirable to provide a novel antenna which is embedded for saving space for accommodating other electronic devices or for future expansion.

SUMMARY OF THE INVENTION

It is an object of the present invention to provide a printed-on-display (POD) antenna mounted on a wireless mobile personal terminal. The POD antenna is formed of conductive transparent material such as indium oxide doped with tin oxide (ITO). POD antenna is printed on a glass substrate of display of wireless mobile personal terminal by physical vapor deposition (PVD) or chemical etching. The pattern of POD antenna is configured to have a radiation pattern same as a conventional monopole antenna and an omni-directional characteristics. Hence, POD antenna may be embedded, resulting in an elimination of drawbacks of conventional exposed antenna such as liable to damage, complex in assembly, and high in cost.

In one aspect of the present invention, a liquid crystal display (LCD) mounted on a wireless mobile personal terminal is made of ITO. The POD antenna is printed on a glass substrate of LCD of wireless mobile personal terminal, i.e., POD antenna is integrated with LCD during manufacturing process so as to produce a LCD having wireless communication capability.

In another aspect of the present invention, antenna is formed of conductive transparent material such as ITO in lieu of conventional metal material. Hence, antenna is made easy to integrate with glass substrate of LCD during manufacturing process so as to form a complete module, resulting in a reduction in the manufacturing cost, an improvement of electrical characteristics, and an increase of added value.

In a further aspect of the present invention, the POD antenna is integrated with LCD. Such embedded configuration can save space. When the POD antenna is mounted on a conventional wireless mobile personal terminal such as GSM based mobile phone, the drawbacks of conventional exposed antenna such as liable to damage, complex in assembly, and high in cost are completely eliminated.

The above and other objects, features and advantages of the present invention will become apparent from the following detailed description taken with the accompanying drawings.

DETAILED DESCRIPTION OF THE PREFERRED EMBODIMENTS

A printed-on-display (POD) antenna mounted on a wireless mobile personal terminal according to the invention is manufactured through a plurality of processes as below:

First prepare a conductive transparent material such as indium oxide doped with tin oxide (ITO) or tin dioxide (SnO2). Then ionize an introduced argon (Ar) by physical vapor deposition (PVD) in a vacuum system. Hence, argon ions (Ar+) and electrons are generated by applying a plasma wherein Ar+ are impinged on ITO for causing the components of ITO to decompose and adhere on a glass substrate by sputtering. Thus, a uniform ITO film is formed on the glass substrate. Practically, POD antenna is formed if a mask having an antenna pattern is preformed on the glass substrate. Alternatively, after ITO film is formed a photoresist layer is coated on the glass substrate having the transparent ITO film already formed thereon by sputtering. Then coat the mask having an antenna pattern on the photoresist layer prior to ultraviolet (UV) rays exposure. Next immerse the exposed glass substrate in a developing solution for developing in order to remove yet cured photoresist. Etch ITO film on the glass substrate by a chemical process. Finally, clean the remained photoresist, thus forming a pattern of POD antenna on ITO film of the glass substrate.

Above glass substrate is used as a glass substrate on display of wireless mobile personal terminal according to the invention. Hence, POD antenna printed on a surface of the glass substrate may serve as antenna of personal terminal in lieu of conventional monopole antenna. As a result, the size of personal terminal is possible of being further reduced. The pattern of POD antenna is configured to have a radiation pattern same as the conventional monopole antenna and an omni-directional characteristics. The other surface of glass substrate is formed of the same material as the opposite surface thereof and is formed into a ground or remained unprocessed. Hence, POD antenna may be embedded, resulting in an elimination of drawbacks of conventional exposed antenna such as liable to damage, complex in assembly, and high in cost.

Figure 1:
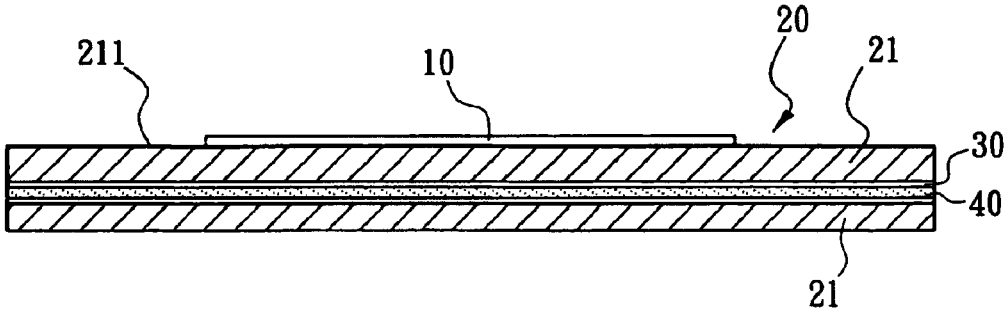
FIG. 1 is a sectional view of a first preferred embodiment of printed-on-display (POD) antenna integrated with LCD according to the invention.

Referring to FIG. 1, there is shown an electrode 30 formed of ITO film on the inner surface of upper glass substrate 21 of a conventional liquid crystal display (LCD) 20. Liquid crystal 40 filled between glass substrates 21 is thus driven by the electrode 30 which is served as light valve accordingly. In printing POD antenna 10 of the invention on LCD 20, the POD antenna 10 is printed on the outer surface 211 of upper glass substrate 21. Hence, pattern of POD antenna 10 formed on ITO film of the outer surface 211 may not adversely affect the normal operation of electrode 30. Alternatively, POD antenna 10 is covered by an additional transparent glass substrate without affecting the normal operation thereof.

Figure 2:
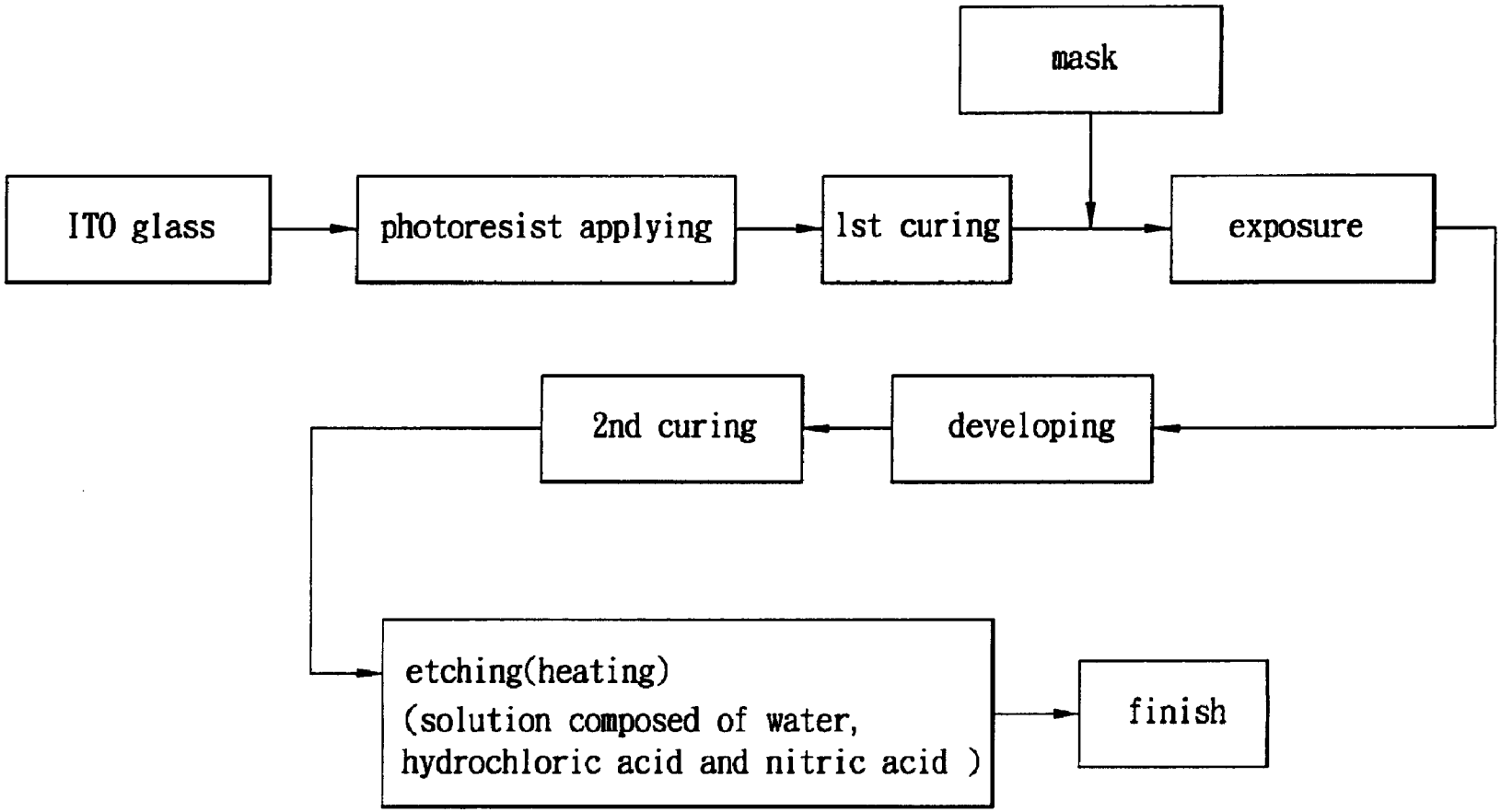
FIG. 2 is a flow chart illustrating a process for manufacturing a POD antenna according to a second preferred embodiment of the invention.

FIG. 2 is a flow chart illustrating a process for manufacturing a POD antenna according to a second preferred embodiment of the invention. The manufacturing process is detailed as below:

First decompose a conductive transparent material such as ITO by physical vapor deposition (PVD) to cause components thereof to adhere on a glass substrate. Thus, a uniform ITO film is formed on the glass substrate. A photoresist layer is coated on the glass substrate having the transparent ITO film already formed thereon by sputtering. Then cure the photoresist layer in a temperature range of 75° C. to 85° C. for a first predetermined period of time. Then coat a mask having an antenna pattern on the photoresist layer prior to ultraviolet (UV) rays exposure. Next immerse the exposed glass substrate in a developing solution for developing in order to remove yet cured photoresist. Then cure the photoresist layer in another temperature range of 110° C. to 130° C. for a second predetermined period of time. Then etch ITO film on the glass substrate by a heated solution composed of water, hydrochloric acid, and nitric acid having a ratio of 1:1:0.08. Finally, clean the remained cured photoresist, thus forming a pattern of POD antenna on the ITO film.

Figure 3:
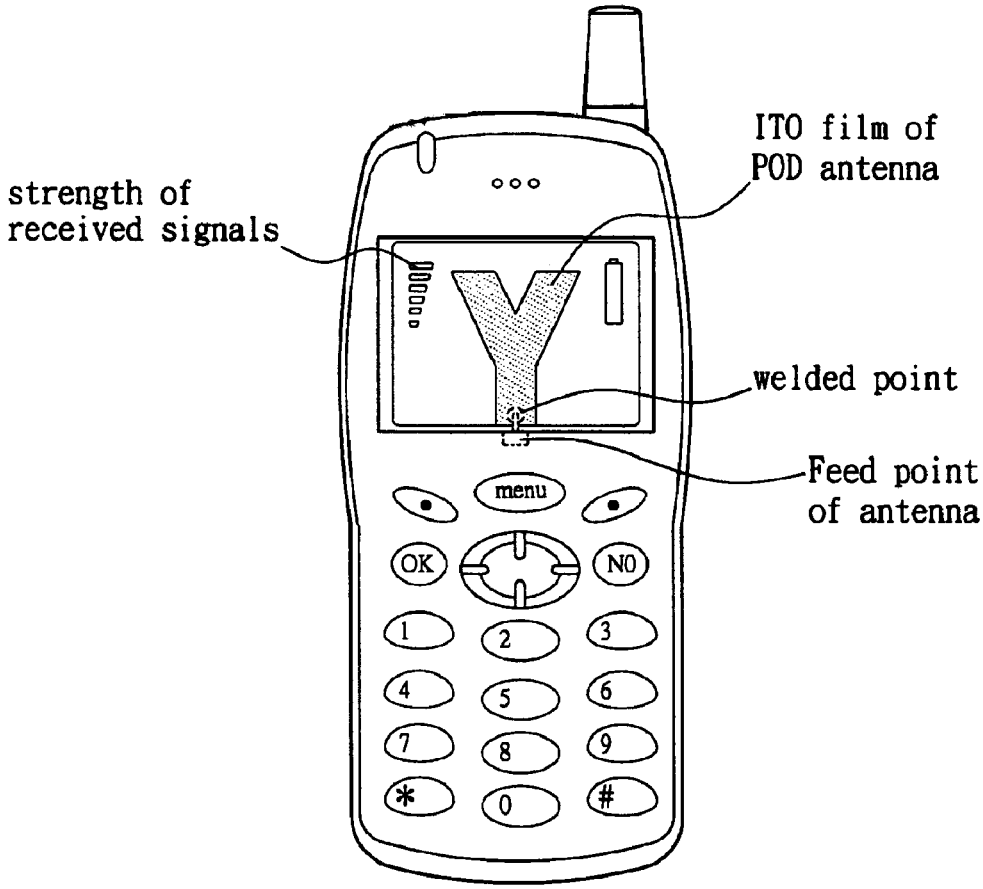
FIG. 3 is view illustrating the strength of signal received by a mobile phone incorporating a POD antenna according to the second preferred embodiment of the invention.
Figure 4:
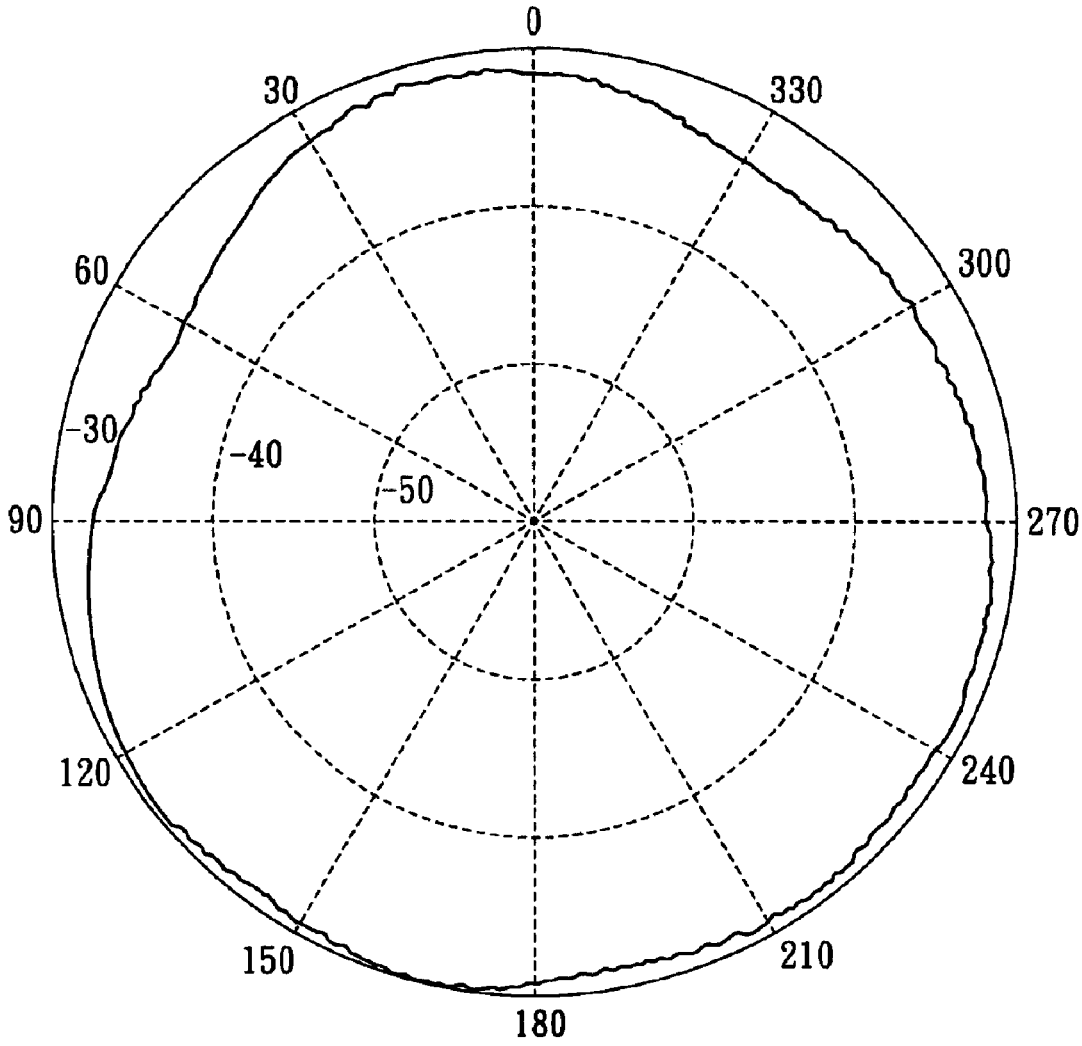
FIG. 4 is a schematic diagram showing a radiation pattern measured on the POD antenna of FIG. 3 performed in an experiment in an anechoic chamber.

In installing the POD antenna, first remove a conventional monopole antenna from GSM mobile phone. Then mount a glass substrate having formed POD antenna on the LCD of the mobile phone. Next couple an industrial 50 Ω microcable to a RF circuit of the mobile phone, thus electrically connecting POD antenna to the mobile phone. Also, the RF circuit may be arranged in conjunction with interface bus for ensuring a better transmission in practice. When the mobile phone is turned on, the strength of received signals by the mobile phone is the strongest as illustrated in FIG. 3. Hence, the signal receiving capability of the mobile phone having a mounted POD antenna is very well. FIG. 4 is a schematic diagram showing a radiation pattern measured on the POD antenna of FIG. 3 performed in an experiment in an anechoic chamber. The shape of radiation pattern is much similar to the one obtained by a conventional monopole antenna mounted on a mobile phone. Hence, a mobile phone incorporating the POD antenna of the invention is capable of obtaining a radiation pattern with omni-directional characteristics. This basically meets the requirement of a wireless communication personal terminal on wireless communication.

In the embodiments described above, the shape of the pattern of POD antenna is a trapezoid for obtaining a better transmission and receiving efficiency. While it is appreciated by those skilled in the art that above pattern may be configured as one of others depending on applications without departing from the scope and spirit of the invention. Further, the manufacturing process may be not limited to sputtering. Other techniques such as physical vapor deposition (PVD) or chemical vapor deposition (CVD) may be used as long as the transparent conductive material is made possible of printing on the glass substrate and is formed into a pattern of POD antenna accordingly.

In brief, a transparent conductive material is used as radiation material. Further, a printing, sputtering, or etching is used to print the material on glass substrate of LCD of wireless mobile personal terminal for forming a POD antenna. This can facilitate the integration of POD antenna with LCD during manufacturing process, resulting in an elimination of drawbacks of conventional technique such as liable to damage, complex in assembly, and high in cost. Most importantly, the electrical characteristics of antenna of mobile phone is much enhanced.

While the invention has been described by means of specific embodiments, numerous modifications and variations could be made thereto by those skilled in the art without departing from the scope and spirit of the invention set forth in the claims.

What is claimed is:

1. A process of manufacturing a printed-on-display (POD) antenna of a wireless mobile personal terminal having a crystal liquid display (LCD), comprising preparing a conductive transparent material; coating a uniform layer of said conductive transparent material on a glass substrate of said LCD; coating a photoresist layer on said conductive transparent layer; coating a mask having an antenna pattern on said photoresist layer; exposing said mask by ultraviolet (UV) rays; immersing said glass substrate in a developing solution for developing the photoresist layer for removing cured portions of photoresist layer to form a patterned photoresist layer; etching said conductive transparent layer on said glass substrate to form a patterned conductive transparent layer which serves as said POD antenna; and removing said patterned photoresist layer.

2. The process of claim 1, wherein said conductive transparent material is an indium oxide doped with tin oxide (ITO).

3. The process of claim 1, wherein said conductive transparent material is a tin dioxide (SnO2).

4. The process of claim 2 or 3, wherein said step of coating a uniform layer of said, conductive transparent material on said glass substrate comprises ionizing an introduced argon (Ar) by sputtering in a vacuum system, generating argon ions (Ar+) and electrons by applying a plasma wherein said Ar+ are impinged on said conductive transparent material for causing components of said conductive transparent material to decompose and adhere on said glass substrate by sputtering, and forming said uniform layer of said conductive transparent material on said glass substrate.

5. The process of claim 2 or 3, wherein said step of coating a uniform layer of said conductive transparent material on said glass substrate further comprises decomposing said components of said conductive transparent material and adhering said same on said glass substrate by sputtering, and forming said uniform layer of said conductive transparent material on said glass substrate.

6. The process of claim 1, wherein said etching of said conductive transparent layer is performed by a plasma.

7. The process of claim 1, wherein said etching of said conductive transparent layer is performed by a strong acid.

8. The process of claim 7, wherein said strong acid is formed of a solution composed of water, hydrochloric acid, and nitric acid having a predetermined ratio.

9. The process of claim 1, wherein said POD antenna is formed on a surface of said glass surface of said glass substrate on said LCD.

10. The process of claim 1, wherein said POD antenna is electrically coupled to a radio frequency (RF) circuit of said wireless device.

* * * * *